United States Patent [19]

Krouwel

[11] Patent Number: 4,503,592

[45] Date of Patent: Mar. 12, 1985

[54] FELTING MACHINE FOR SLIVER OR YARN

[75] Inventor: Jan Krouwel, Hengelo, Netherlands

[73] Assignee: Hollandse Signaalapparaten B.V., Netherlands

[21] Appl. No.: 454,210

[22] Filed: Dec. 29, 1982

[30] Foreign Application Priority Data

Jan. 12, 1982 [NL] Netherlands ..... 8200085

[51] Int. Cl.[3] ..... D04H 17/00

[52] U.S. Cl. ..... 28/219; 68/143; 226/113

[58] Field of Search ..... 68/43, DIG. 1; 28/219, 28/281, 134; 226/113, 190; 57/295

[56] References Cited

U.S. PATENT DOCUMENTS

| | | | |
|---|---|---|---|
| 3,644,968 | 2/1972 | Elliott et al. | 28/281 |
| 3,981,129 | 9/1976 | Briaire | 28/134 |

FOREIGN PATENT DOCUMENTS

| | | | |
|---|---|---|---|
| 53-126338 | 4/1977 | Japan | 28/281 |
| 1161673 | 8/1969 | United Kingdom | 28/281 |
| 2090296 | 7/1982 | United Kingdom | 28/219 |

*Primary Examiner*—Werner H. Schroeder
*Assistant Examiner*—Andrew M. Falik
*Attorney, Agent, or Firm*—David R. Treacy

[57] ABSTRACT

A tension adjusting device for the oscillating guide tubes in a sliver felting machine comprises a lever mechanism with a first tension adjuster for exerting a tension simultaneously on a plurality of guide tubes. A second tension adjuster is included for exerting tension on the guide tubes individually.

4 Claims, 2 Drawing Figures

FELTING MACHINE FOR SLIVER OR YARN

The invention relates to a felting machine comprising elastic guide tubes which perform such an oscillating motion that axial forces act on the slivers or yarns supplied to the separate guide tubes to achieve a felting of the slivers or yarns.

Such a machine is known from the Dutch patent application No. 74.06622 to which U.S. Pat. No. 3,981,129 corresponds. To obtain the above-mentioned oscillating motion, the felting machine comprises a rotor, consisting of a shaft fitted with a number of discs which are interconnected at the edges by rods provided with rolls. The elastic guide tubes are fitted with half a turn around the rotor; that is, they are fitted around the rods provided with rolls and are otherwise attached with the two ends to the machine housing. One end of the guide tubes is immersed in a felting liquid. At the other end of the tubes are perforations. These performations are used to obtain a desired fluid pressure in the guide tubes, when the rotor is driven at a corresponding speed in the appropriate direction. The slivers or yarns are applied to the ends of the guide tubes situated in the felting liquid, and are subjected in these tubes to a peristaltic motion, giving rise to the felting process. Some of the determining factors of the degree of felting are the diameter and the tension of the guide tubes, the liquid pressure in these tubes and the speed at which the rotor is driven.

It appears however that the tension in the guide tubes decreases relatively fast in time through elongation. This means that the machine must be stopped at regular intervals to correct the tension at which the guide tubes are fitted round the rotor, e.g. by adjusting the position of their ends at the point of attachment to the machine housing, or to replace the elongated tubes. The present invention has for its object to obviate this disadvantage.

According to the invention, the felting machine comprises a lever mechanism provided with a first adjusting means for exerting an equal and adjustable tension on all of the guide tubes. As in practice the guide tubes will never be subjected to elongation at the same time, the lever mechanism, further according to the invention, comprises second adjusting means for exerting on each of the guide tubes a separately adjustable tension superimposed on the tension exerted on all tubes simultaneously. With the use of the first and second adjusting means the tension, reduced through elongation, in the separate tubes can be returned to its original value.

The invention will now be described with reference to the accompanying figures, of which:

Figure 1:
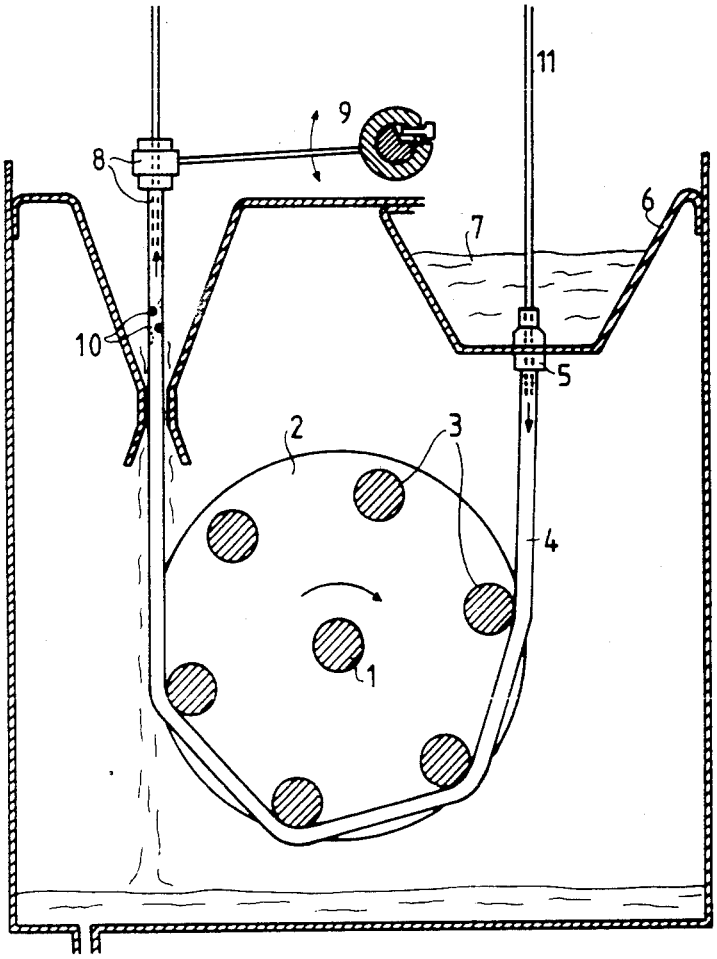
FIG. 1 is a schematic sectional view of the felting machine.

In the felting machine shown in FIG. 1 the rotor consists of a shaft 1, a number of discs fitted side by side on this shaft, where only disc 2 is exposed to view, and a number of rods 3 fitted with rolls, which rods interconnect the discs at the edges. In the embodiment in question, six of these rods are provided. The elastic guide tubes, of which only tube 4 is shown, are fitted half a turn around the rotor, i.e., around the rods 3. One end of the guide tubes is rigidly attached to the machine housing; the points of attachment—for tube 4 this is point of attachment 5—are at the bottom of a troughed reservoir 6. Reservoir 6 is filled with a felting liquid 7.

The guide tubes are filled fully with this liquid. The other end of the guide tubes, denoted by 8, is attached to a lever mechanism 9, described hereinafter with reference to FIG. 2. Near the end 8 the tubes contain perforations 10. These perforations are of importance to the desired liquid pressure inside the tubes, which pressure arises through the liquid in the tubes being forced to end 8 when the rotor is driven in the direction indicated by the arrow. The sliver or yarn 11 enters the tube 4 at point of attachment 5 and undergoes in the tube a peristaltic motion, i.e. an oscillating motion, whereby axial forces act on the sliver or yarn to produce the felting.

Figure 2:
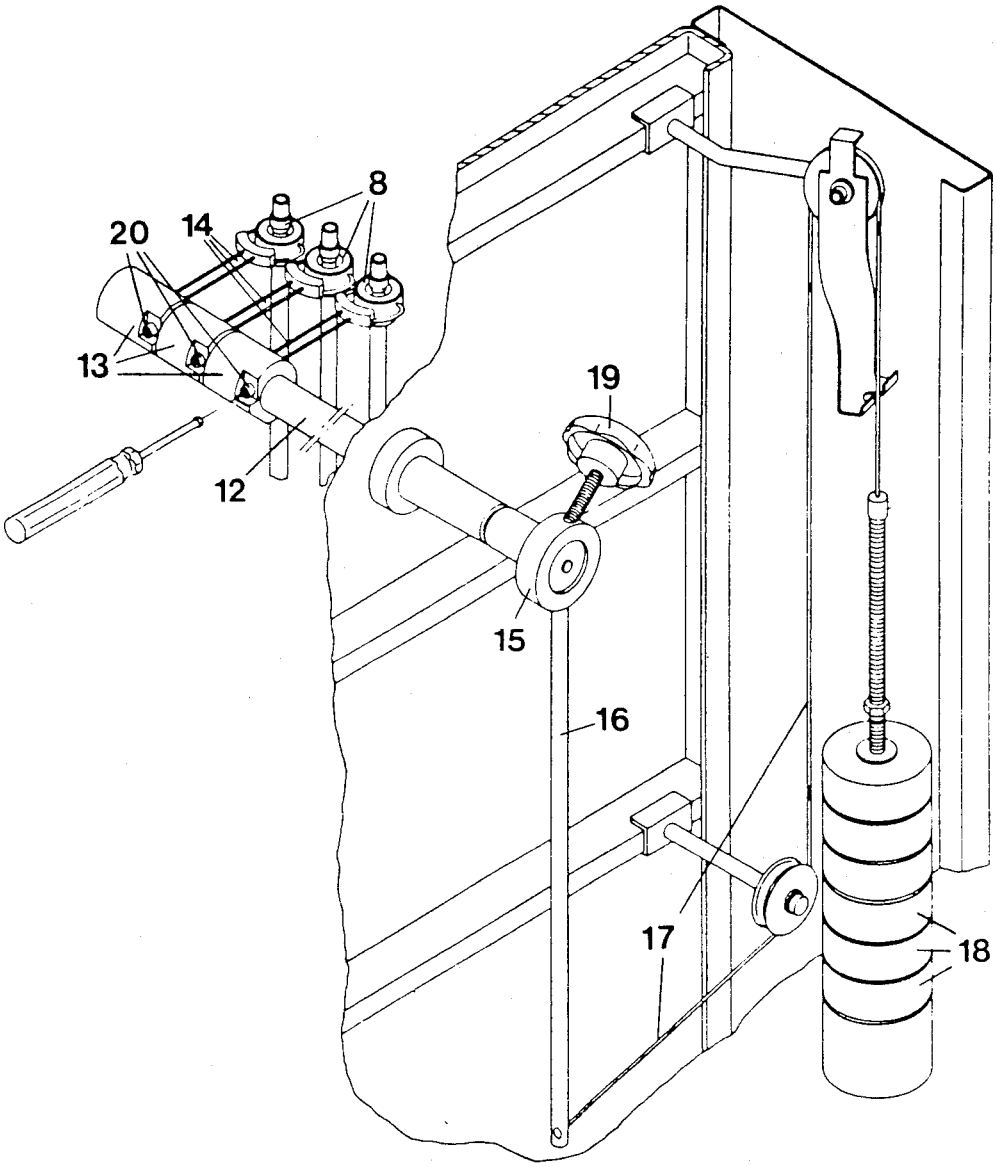
FIG. 2 is a perspective view of the lever mechanism employed therein.

The longer the machine is in use, the more the guide tubes will be subjected to elongation; consequently, their fitting around the rotor will be slackened, reducing the felting of the supplied slivers or yarns. To be able to exert an adjustable tension on the guide tubes, a lever mechanism 9 is provided for relocating the tubes in such a way that they fit with sufficient tightness around the rotor. An embodiment of the lever mechanism 9 is shown in FIG. 2. This lever mechanism comprises a shaft 12 and a number of tubular elements 13. Each of elements 13 is provided with an arm 14, to the end of which the end 8 of a guide tube is hingedly connected. Through rotation of the shaft 12 the tension in the guide tubes is adjustable to a value which equally applies to all tubes. To achieve such a rotation of the shaft 12, the lever mechanism is provided with first adjusting means. The first adjusting means comprises: a tubular element 15, fitted on the shaft 12; a transmission mechanism constituted by a lever 16 and a steel wire 17; weights 18; and a set screw 19. The number of weights 18 determines the coarse setting of the shaft 12. With the set screw 19 the tubular element 15 and the lever 16 are so positioned relative to the shaft 12 that with an elongation of the guide tubes, whereby the lever 16 and the weights 18 will be displaced, the lever and the weights will be returned to their original position. In order to exert on each of the guide tubes a separately adjustable tension superimposed on the tension exerted on all tubes simultaneously, the lever mechanism is provided with second adjusting means. In the embodiment in question the second adjusting means consists of screws 20 fitted in the tubular elements 13. Screws 20 permit a fine setting of each tubular element 13 relative to shaft 12.

I claim:

1. Felting machine provided with elastic guide tubes which perform such an oscillating motion that axial forces act on the slivers or yarns supplied to the separate guide tubes to achieve a felting of the slivers or yarns, characterised in that the felting machine comprises a lever mechanism provided with first adjusting means for exerting an equal and adjustable tension on a number of the guide tubes.

2. Felting machine as claimed in claim 1, characterised in that the lever mechanism comprises second adjusting means for exerting on each of the guide tubes a separately adjustable tension superimposed on the tension exerted by the first adjusting means.

3. Felting machine as claimed in claim 2, characterized in that the first adjusting means comprises weights connected to the lever mechanism and arranged such that, in response to elongation of the guide tubes, displacement of the weights from an original position rotates the lever mechanism to maintain the tension exerted on said number of guide tubes; and a set screw for re-positioning the weights to the original position while maintaining the tension exerted by the first adjusting means.

4. Felting machine as claimed in claim 1, characterized in that the first adjusting means comprises weights connected to the lever mechanism and arranged such that, in response to elongation of the guide tubes, displacement of the weights from an original position rotates the lever mechanism to maintain the tension exerted on said number of guide tubes; and a set screw for re-positioning the weights to the original position while maintaining the tension exerted by the first adjusting means.

* * * * *